US005134985A

United States Patent [19]

Rao

[11] Patent Number: 5,134,985

[45] Date of Patent: Aug. 4, 1992

[54] BURNER FUEL LINE ENHANCEMENT DEVICE

[76] Inventor: Velagapudi M. Rao, 11 Kasturi Estate, Madras, India

[21] Appl. No.: 647,330

[22] Filed: Jan. 28, 1991

[51] Int. Cl.[5] ..... F02M 27/00

[52] U.S. Cl. ..... 123/538; 123/536

[58] Field of Search ..... 123/536, 537, 538; 431/208, 2, 536

[56] References Cited

U.S. PATENT DOCUMENTS

| | | | |
|---|---|---|---|
| 3,116,726 | 1/1964 | Kwartz | 123/538 |
| 3,597,668 | 8/1971 | Yoshimine | 123/538 |
| 3,989,017 | 11/1976 | Reece | 123/538 |
| 4,073,273 | 2/1978 | McMahon | 123/538 |
| 4,074,670 | 2/1978 | Roberts et al. | 123/538 |
| 4,381,754 | 5/1983 | Heckel | 123/538 |
| 4,755,288 | 7/1988 | Mitchell et al. | 123/538 |

OTHER PUBLICATIONS

Feynman, "Cavity Resonators" (The Feynman Lectures on Physics), pp. 23-1 to 23-11. Narosa Publshing House, New Delhi, India, Indian Student Edition 1986, 1988, 1989.

D. K. Kondepudi and I. Prigogine, "Sensivity of Nonequilibrium Systems" 1981, University of Texas, Physica 107A, 1-24, North-Holland Publishing Co. Oct. 1980.

*Primary Examiner*—Raymond A. Neill
*Assistant Examiner*—M. Macy
*Attorney, Agent, or Firm*—Skjerven, Morrill, MacPherson, Franklin & Friel

[57] ABSTRACT

An insulated coil (20) of wire (23) of a prescribed length and number of turns is positioned to surround a linearly-extending portion of a metal or plastic fuel conduit (10) associated with an internal combustion engine or conduit transporting a burner gas to a stove burner or furnace. The coil core (22) may be electrically conductive wire which is surrounded by electrical insulation or liquid electrolyte (31) contained in plastic tubing (30) which tubing is coiled around the fuel conduit (10). The use of the device is shown to increase the miles per gallon of fuel performance of an auto and to improve combustion emissions. In gas burner applications, the number of days of use from a standard volume gas cylinder has been substantially increased when the device is used.

11 Claims, 2 Drawing Sheets

BURNER FUEL LINE ENHANCEMENT DEVICE

BACKGROUND OF THE INVENTION

1. Field of the Invention

The present invention relates to a device for improving the performance characteristics of particulate materials and fluids, including liquid fuels such as gasoline and burner cooking or heating gas.

2. Related Art

Internal combustion engines have employed various devices such as catalysts and heating devices for enhancing hydrocarbons being employed as the engine fuel. Heating coils 22 have been used in catalyst beds as seen in U.S. Pat. No. 3,639,200 for conversion of a fuel and regeneration of the catalyst. U.S. Pat. No. 3,928,155 shows coagulation of particles in liquid flowing through a supply conduit where a self-induced e.m.f. uses the liquid as an electrolyte to cause changes in ion charge to form nuclei initiating precipitation of particles. This is done by providing coiled and twisted wires in a stainless steel tube to aid in prevention of scale and corrosion. U.S. Pat. No. 3,116,726 shows an inductance coil surrounding an I.C. engine fuel line between a fuel pump and carburetor which coil is electrically connected to a high-tension ignition system so that the fuel line is subjected to a high intensity magnetic field serving to improve the "hotness" of the spark within the engine cylinders. U.S. Pat. No. 4,073,273 discloses the application of an electrostatic field in an I.C. fuel line to improve anti-knocking and increase available energy for engine operation. Insulated metallic barrels are employed around a fuel line. An electrical circuit provides an intense electrostatic field. Electromagnetic coils are found in U.S. Pat. No. 4,381,754 which surround an I.C. engine fuel line causing a magnetic flux field resulting in increased fuel efficiency. U.S. Pat. No. 4,755,288 uses a magnetic field generator to increasing the energy in the fuel flowing through an I.C. engine fuel line. Electromagnetic coils connected to a battery are utilized around a fuel line in U.S. Pat. No. 3,989,017. An energy efficiency system is seen in U.S. Pat. No. 4,074,670 where a pair of (bare) coil windings having parallel axes are provided in a unit casing with iron cores positioned interiorly of the coils with the ends of the coils interconnected by leads. The unit is attached to the top of the fuel line by a few turns of wires 36 which function only to hold the unit in place.

SUMMARY OF THE INVENTION

The present invention provides a multi-turn insulated coil of wire which surrounds the fuel-carrying conduit. The two opposite terminals of the coil are short-circuited by any suitable means such as by joining through a connector, brazing, soldering, or by other means. The coil may also be wound directly around the conduit or pipe carrying the fluid. Alternatively, the coil may be wound on a cylindrical or split plastic form which can be slipped over the pipe, conduit or conductor. The coil also may be in the form of a molded insert which can be fitted in a pipe, conduit or conductor and used as a connecting piece between separate conduits or pipes.

The performance characteristics of particles and fluids in conduits or pipes have been found to improve if said coils are fitted around the conduits or pipes. The invention relates to a device for improving the flow and performance characteristics of particles and fluids including liquids such as gasoline used in internal combustion engines, or of fuel gas used in cooking or heating in stoves or furnaces. The insulated coil is of predetermined diameter and length, made by winding a predetermined number of turns of an insulated electrical conducting wire of predetermined cross-section on a fuel conduit, or made of wire contained in a hollow form of an electrical insulator placed around the conduit. In another embodiment, a plastic tube of hollow cylindrical form may be filled with an electrolyte with the tube then coiled around the fuel line. In another embodiment, the coil may be bare wire turns wound about an insulative plastic fuel conduit so that each turn is spaced from an adjacent turn and the overall coil then covered by wound layers of tape insulation. In each case the two opposite, terminals of the coil are short-circuited in a predetermined manner.

BRIEF DESCRIPTION OF THE DRAWING

The invention is further described with reference to the accompanying drawings, in which.

DETAILED DESCRIPTION

Figure 1:
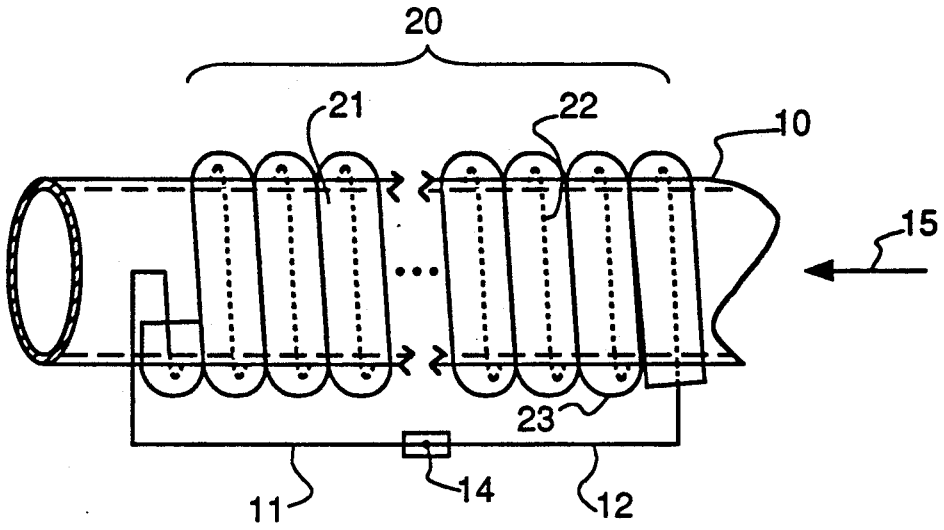
FIG. 1 is a schematic side view of the device showing an insulated coil wound as a right-hand helix in the direction of fluid flow in a conductive conduit.

FIG. 1 shows a fuel line 10 for transporting fuel to an internal combustion (I.C.) engine (not shown) or a household or other burner (not shown) such as a gas stove for cooking or a heating unit. The conduit can be made of a conductive material such as copper or aluminum tubing or of plastic material.

Figure 2:
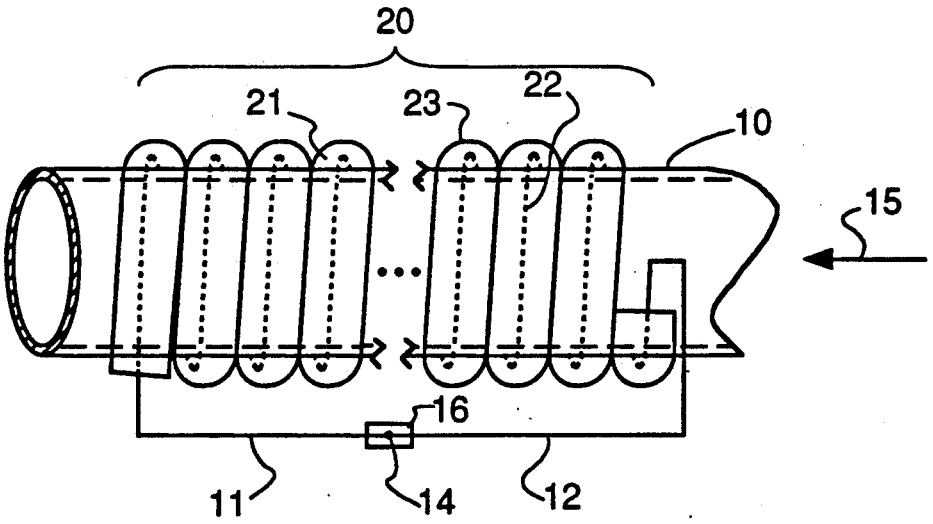
FIG. 2 is a schematic side view of the device showing an insulated coil wound as a left-hand helix in the direction of fluid flow in a conductive conduit.

A coil 20 of wire 23 is wound about the conduit. The helix angle at which the electrical conducting wire 23 in FIGS. 1 and 2 is wound and the number of turns of the resultant coil are varied depending on the extent of improvement of the said flow characteristics desired. The helix angle typically will be from 5° to 45° from the coil longitudinal axis. The preferred number of turns is between 26 and 30 turns extending over an incremental length of the fuel conduit, the length being dependent on the conduit OD and the insulated wire OD. Preferably still the number of turns is 28. Tests were made with as few as five turns and as many as 40 turns but the results were not those sought. Optimum and useful results appeared to be achieved in the 26-30 turn range. The diameter or cross-section of the conduit 10 is determined by the quantity and quality of the fluids to be handled. The diameter or cross-section of wire 23 also depends on the extent of improvement of the fuel characteristics desired to be attained by using the device. In FIG. 1 a right-hand coil lay is employed while in FIG. 2 a left-hand coil lay is seen. The coils normally abut each other so that there is no spacing between the adjacent coils of insulated wire. When bare wire is used on plastic conduit, the adjacent coils of wire are spaced from each other so as not to short circuit directly.

Figure 3:
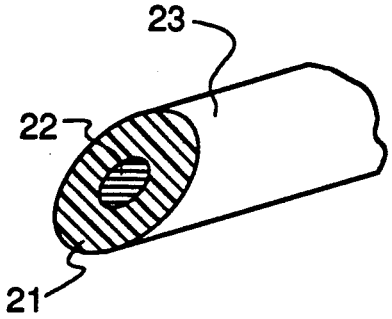
FIG. 3 is a cross-sectional perspective view of the insulated coil-forming wire.
Figure 4:
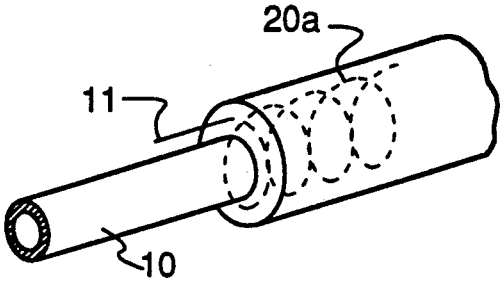
FIG. 4 is a cross-sectional perspective view of a second embodiment of the wire.
Figure 5:
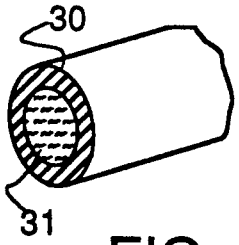
FIG. 5 is a cut-away perspective view of a third embodiment of the wire.

The coil is wound on conduit/pipe, which may be a steel or other metallic pipe or a plastic pipe which is designed for the particular fuel (liquid or gas) being conveyed through the pipe. The wire 23 includes a conductor core 22 covered with an insulating material 21 as seen in FIG. 3. The insulating material may, for example, be polyvinyl chloride, polyethylene or natural or synthetic rubber. Alternatively, the conduit/pipe may be covered as seen in FIG. 4 with a cylindrical shell of an insulating material 30 over an incremental or greater length of the tubing with a coil 20*a* of wire embedded in the shell. The two opposite terminals 11 and 12 of the coil are short-circuited at position 14 by welding, soldering, brazing or by a conventional mechanical connection 16 such as an alligator clip or twist connector. In FIGS. 1 and 2 flow of the liquid fuel or gaseous fuel is in the direction shown by arrow 15. In a third embodiment shown in FIG. 5, the coil is formed in the form of hollow flexible tubing 30 of polyvinyl chloride or other plastic. The hollow structure of the tubing contains a liquid conductive electrolyte 31, such a sodium chloride or potassium chloride in an aqueous solution. The tubing is then wound around the fuel conduit in the necessary number of turns and the ends of the tubing including the electrolyte connected by a coupling so that each end of the tubing is short-circuited with the other i.e. the electrolytic solution extends through the entire fuel conduit-surrounding coil.

Typical examples of the application of the novel device are presented below:

EXAMPLE I

Emission tests were carried out on the exhaust gases from a Fiat 1100 cc. auto by the Indian Institute of Technology in Madras, India. The tests were carried at idling speed about (700–800 RPM) on a stationary car. The analyzer used was a portable Horiba (Japan) HC/CO analyzer.

| Results were as follows: | |
|---|---|
| HC/PPM | CO |
| Without Device | |
| 790–810 | 3.8–3.93 |
| With Device | |
| 740–750 | 3.75–3.95 |

HC—Hydrocarbon
CO—Carbon Monoxide

A difference of 50 PPM in HC emissions, i.e. about 6% improvement was obtained.

EXAMPLE II

A Menlo Park, Calif. test was carried out at idling on an American car without a catalytic converter. An engine analyzer was used.

| Emissions Readings (Without Device) | | | |
|---|---|---|---|
| HC: | 215 ppm | CO: | 1.82% |
| $CO_2$: | 11.9% | $O_2$: | 2.9% |
| 917 RPM | | | |
| Emissions Readings (With Device) | | | |
| HC: | 199 ppm | CO: | 1.41% |
| $CO_2$: | 12.1% | $O_2$: | 2.9% |
| 920 RPM | | | |

The results were printed out at approximately the same engine idling R.P.M.

A difference of HC omissions of about 6% was obtained. A significant reduction in CO, about 20%, was obtained unlike the Indian results. A possible explanation for the variation in the absolute values of the tests between the Indian and U.S. results could be as follows:

a) Leaded petrol is used in India as a fuel, unlike the U.S.A.

b) The relative humidity in Madras, India is of the order of 85%, unlike Menlo Park which is much drier.

EXAMPLE III

Mileage Test, India, Madras

A Kawasaki Bajaj 100 cc. motorbike was used. A test ride circuit on relatively traffic-free city roads was used. The speed maintained was between 40–50 kmph.

The test procedure was as follows. Half a liter of petrol was poured into an empty fuel tank each time. The motorbike was operated on the chosen circuit until the fuel tank was empty. Kilometer readings were noticed from the speedometer at the beginning and end of each run.

The kilometers travelled were as follows:

| Run | Without Device Kilometers Travelled | With Device Kilometers Travelled |
|---|---|---|
| 1) | 27 kms | 31 kms |
| 2) | 31 kms | 34 kms |
| 3) | 30 kms | 37 kms |

Discarding run no. 3, an average increase of about 10% was obtained.

EXAMPLE IV

U.S.A.. Menlo Park, Calif. to San Jose, Calif.

A fuel injection Oldsmobile with an onboard mileage computer was used. The car was driven each time on a flat stretch of about 10 miles on the six-lane 101 Highway between Menlo Park and San Jose, once at 50 MPH, and then at 55 MPH in non-rush hour light traffic.

The onboard computer was set to give instantaneous miles per gallon (IMPG) readings. The test results were done once with and once without the device.

No appreciable difference could be noticed between the tests at 50 MPH and 55 MPH. There was hardly any wind observed.

| Without Device I.M.P.G. | With Device I.M.P.G. |
|---|---|
| 27–40 | 32–43 |

Here the device was mounted on the fuel pipes in situ, i.e. 28 turns of insulated wire (Indo Cables 23 strand copper wire) were wound directly on two metal fuel pipes (about ⅜" O.D.) leading to engine cylinder injectors. Three layers of black insulating tape (electricians) was wound about the coil and the short-circuit connection of the coil ends.

The driver reported that he found it easier to maintain a constant speed with the device than without the device. The above results would also indicate a savings in fuel though the wire length and number of coils used was not optimized for this size of engine and was the same as used in the device described above for engines from 50 cc. to 1.1 liter and normal household gas stoves (Indians commonly use two-burner stoves.)

General Results

An improvement in engine torque at low engine RPM has been noticed when driving a car fitted with the device by several drivers, both in India and the U.S.A.

Starting from a cold start condition is also improved. Hence battery life should be improved.

No deterioration in performance of the cars and mopeds fitted with the device over several months of testing has been noticed. Essentially the improvement in performance of the vehicle fitted with the device appears to remain constant.

The only deleterious effect noticed so far in India is that exhaust tailpipe corrosion is considerably accelerated. However, it should be noted that exhaust tailpipes of Indian cars are made of ordinary steel and not of stainless steel. This would also indicate that exhaust tailpipe temperature is lower with the device fitted.

EXAMPLE V

Gas Stoves/Madras, India

Three families were selected from different backgrounds and different income levels. These people had also kept reasonable records of how long a cylinder of cooking gas would last, usually between 28 to 35 days. The figure was, however, substantially constant for each household.

The device was fitted onto the fuel pipe from the gas cylinder to the stove and they were asked to keep records of how long the cylinder lasted. Cylinders are supplied in India by the government-owned oil company. About five months of observation are available. An increase in the number of days a cylinder of gas would last was obtained by all three families. The increase was between 10 to 15%. The experiment is still going on. These results would indicate that no external electrical field is necessary. The families have reported that the burners have a bluer flame when the device is incorporated on the fuel line than they have seen from the prior fuel line without the coil device installed.

A typical device as used on fuel pipes of engines between 50 cc. to 1.1 liter and on the gas pipe of household gas stoves uses a former of ordinary household PVC piping (⅝" I.D., 3½" long). Two holes of ⅜" diameter are drilled, one on each end of the pipe about ¼" from the edges. The purpose of the holes is to anchor the coil to the former. The cable used is Indian specification Indo Cables copper multistrand wire with 23 strands. Diameter of the wire was 0.006 inch. Outer insulation is PVC or other plastic. A right-hand coil of 28 turns is tightly wound on the former with no spacing between the abutting turns. The ends of the coil pass through the holes in the pipe former and are connected by a banana jack and socket so that the coil can be quickly short-circuited. The coil is then wrapped with three layers of black insulation tape. Alternatively the coil ends may be twisted together or metallurgically bonded by soldering, brazing or welding.

Figure 6:
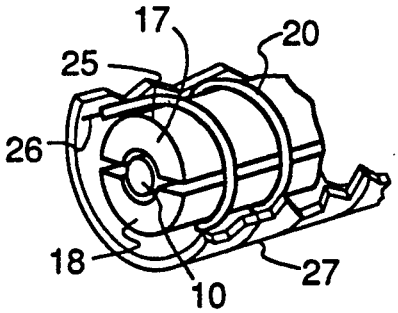
FIG. 6 is an end view of a fourth embodiment of the coil.

The former is slipped on to the fuel pipe leading to the carburetor or onto the gas fuel pipe leading to the stove. When the coil is short-circuited, it is operative. As seen in FIG. 6, two half cylindrical shells 17 and 18 of PVC may be placed on the top and bottom of the fuel line 10 and bare or insulated wire 25 wound around the two half shells. The outer surface of the wound unit can then be covered by insulating tape 27 and the ends 26 of the coil interconnected.

Other suitable applications of the invented device with beneficial effects may be as follows, although tests have not been made to date.

Figure 7:
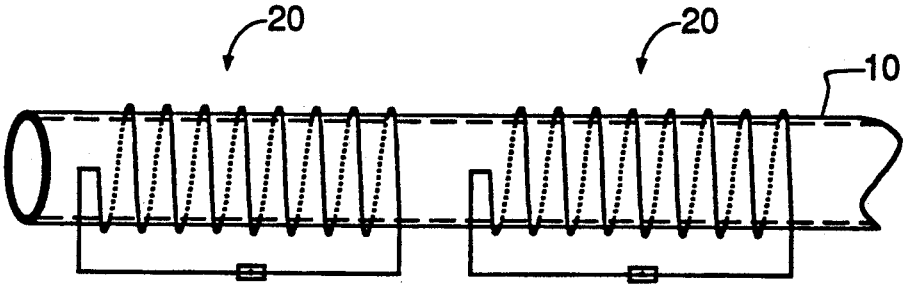
FIG. 7 shows a pair of separate shorted coils on a conduit.

1. On the inlet pipe to the air filter, on the wire from the magneto to the spark plugs and on the exhaust pipe of an I.C. engine in a motor car;

2. On all the pipes carrying inlet streams to a reactor and on all the pipes carrying outlet streams from a reactor;

3. On the inlet stream pipes carrying oil, gas, coal dust, etc. to a boiler or gas producer;

The invented device also may be constructed by utilizing a plurality of coils spaced on the fuel conduit as seen in FIG. 7 where the coils 20 are spaced on fuel conduit 10 and each separately short-circuited.

Based on additional tests, prior publications, and expert opinion, it is believed that the coil(s) used in the above described invention may act as a microwave antenna which picks up external weak electromagnetic fields which in turn influences chemical kinetics. Particularly, attention is directed to the 1981 Article of D. K. Kondepudi and I. Prigogine of the University of Texas (Austin) under a U.S. Air Force Grant published in Physica 107A 1-24 North-Holland Publishing Co. Feynman in his Lectures on Physics Chapter 23 discusses broadly the action of magnetic fields on coils.

The above description of embodiments of this invention is intended to be illustrative and not limiting. Other embodiments of this invention will be obvious to those skilled in the art in view of the above disclosure.

I claim:

1. A device for improving the performance characteristics of particulate material and fluids flowing through a fuel conduit comprising:

at least one coil of predetermined diameter and length and of a predetermined number of turns, said coil comprising an electrical conductor core and electrical insulation therearound and being coiled around a length of said fuel conduit, the ends of said electrical conductor core being connected together so as to be short circuited.

2. The device of claim 1 in which said core is a continuous wire surrounded by plastic insulation.

3. The device of claim 1 in which said coil is a flexible hollow tube and said core is a liquid electrolyte.

4. The device of claim 1 wherein the number of turns of said coil is from about 26 to about 30.

5. The device of claim 4 wherein the number of turns is about 28.

6. The device of claim 1 wherein a plurality of separate coils spaced on the fuel conduit are provided.

7. The device of claim 1 wherein opposite ends of said coil are metallurgically bonded to each other to effect the short circuiting.

8. The device of claim 1 wherein said fuel conduit is a metal conduit and said coil core is copper.

9. The device of claim 1 wherein said coil core is an aluminum wire.

10. The device of claim 1 wherein said coil comprises a plastic sleeve having a prescribed number of turns of wire embedded therein.

11. The device of claim 1 wherein said coil comprises a pair of plastic half shells surrounding said fuel conduit, a prescribed number of turns of a conductive wire spacedly wound around said shells and a layer of insulation surrounding said wire turns.

* * * * *

UNITED STATES PATENT AND TRADEMARK OFFICE

CERTIFICATE OF CORRECTION

PATENT NO. : 5,134,985

DATED : August 4, 1992

INVENTOR(S) : Velagapudi M. Rao

It is certified that error appears in the above-indentified patent and that said Letters Patent is hereby corrected as shown below:

On the title page: Item [76]

delete "11 Kasturi Estate, Madras, India" and insert --5, Damodarapuram, Vannanthural Road, Adyar, Madras-600 020, India--.

Col. 3, line 39, delete "(700-800 RPM)" and insert --(450-500 RPM)--.

Col. 4, line 3, delete "omissions" and insert --emissions--.

Signed and Sealed this

Twenty-eighth Day of December, 1993

*Attest:*

Bruce Lehman

BRUCE LEHMAN

*Attesting Officer*

*Commissioner of Patents and Trademarks*